United States Patent [19]

Thiem

[11] Patent Number: 4,960,185

[45] Date of Patent: Oct. 2, 1990

[54] MOVABLE CRADLE

[75] Inventor: Gerhard Thiem, Haan, Fed. Rep. of Germany

[73] Assignee: GESTA Gesellschaft für Stahlrohrgerüste mbH, Berlin, Fed. Rep. of Germany

[21] Appl. No.: 373,866

[22] Filed: Jun. 29, 1989

[30] Foreign Application Priority Data

Jun. 30, 1988 [DE] Fed. Rep. of Germany ..... 3822424

[51] Int. Cl.[5] ..... E04G 3/10; E04G 3/16

[52] U.S. Cl. ..... 182/38; 182/142; 182/150; 182/187

[58] Field of Search ..... 182/36, 37, 38, 142, 182/143, 144, 150, 129, 187

[56] References Cited

U.S. PATENT DOCUMENTS

| | | | |
|---|---|---|---|
| 2,881,029 | 4/1959 | Tollefsen | 182/142 |
| 3,114,433 | 12/1963 | Downs | 182/142 |
| 3,364,520 | 9/1968 | Anderson | 182/142 |
| 3,375,900 | 4/1968 | Conley et al. | 182/150 |
| 3,537,545 | 11/1970 | Willis | 182/142 |
| 3,837,428 | 9/1974 | Gish | 182/142 |
| 4,055,139 | 10/1977 | Scheiding | 182/142 |
| 4,120,378 | 10/1978 | Mills | 182/142 |
| 4,355,699 | 10/1982 | Smith | 182/142 |
| 4,421,205 | 12/1983 | Vranish | 182/142 |

FOREIGN PATENT DOCUMENTS

| | | |
|---|---|---|
| 1866876 | 11/1962 | Fed. Rep. of Germany . |
| 2014102 | 10/1970 | Fed. Rep. of Germany . |
| 8531513 | 2/1986 | Fed. Rep. of Germany . |

*Primary Examiner*—Reinaldo P. Machado
*Attorney, Agent, or Firm*—Nils H. Ljungman & Associates

[57] ABSTRACT

The invention relates to a vertically and horizontally movable work platform 4 for carrying out renovations to the concrete on reinforced concrete buildings or for replacing the structural protection on steel constructions. To increase the operational safety these work platforms 4 are held against the surfaces 1 of the buildings by attached magnetic plates 6. Since the tensions cables previously required are dispensed with, the weight of the upper carriage 2 from which the work platforms are suspended by cables is considerably reduced.

6 Claims, 4 Drawing Sheets

MOVABLE CRADLE

BACKGROUND OF THE INVENTION

1. Field of the Invention

These types of movable cradles are used in particular on buildings which have a constant or variable circular outline, such as for example chimney stacks which are circular or frusto-conical, telecommunications towers which are rotationally paraboloid, or cooling towers which are rotationally hyperboloid, or similar buildings. The movable cradles can be used for example to carry out renovation work on the concrete or to replace the anti-corrosion covering on steel structures.

2. Description of the Prior Art

The known movable cradles have a work platform, more particularly of light metal, which can be moved up and down on cables by means of special winches. At the top edge of the building there is an upper carriage which can move round in a circle. The work platform is suspended from the upper carriage by moving guide cables. These known movable cradles also have tension cables which are braced to fix the work platform in position to prevent it from swinging about radially and tangentially in the wind. These tension cables are fixed at the bottom to consoles which can be moved on rails.

The pretensioning force necessary for a safe operation is susbtantially dependent on the structural height between the upper carriage and the lower rail. Higher pretensioning forces are necessary for example for movable cradles used on the inside walls of cooling towers. In these cases additional pressure must be applied to the work platforms is those areas which are off-set outwards relative to the upper suspension point.

For movable cradles on the outside faces such buildings, additional equipment is necessary to press the work platform against the building.

This type of work platform is known from DE-OS No. 20 14 102 has a blower which produces an underpressure zone between the suspended platform and the wall in order to hold the platform against the wall by suction. Alternatively this blower can blow against the wall to produce a compressed air cushion between the wall and the work platform so that the latter is held at a certain distance from the wall by the air cushion.

DE- G No. 85 31 513 U1 describes an auxiliary structure wherein at least one flow machine producing a thrust force is mounted on or in the work platform with its pressure side on the side of the work platform remote from the wall and directed away from the wall.

OBJECT OF THE INVENTION

The invention is based on the problem of designing the work platform of such movable cradles so that the known tension cables can be eliminated although the work platform can still be reliably pressed against the building even where there are curved surfaces and can be moved in two directions at right angles to each other safely secured against swinging around.

SUMMARY OF THE INVENTION

The magnetic plates which are attached by jibs each side of the work platform hold the latter securely against the building surface which consists of reinforced concrete or steel. The magnetic plate is fitted with roller balls through which it is guided over the building surface. Since there is no longer any swinging or swaying the operational safety is increased and the psychological as well as physiological working conditions for the men on the platform are improved. The tension cables which have a considerable inherent load and are affected by the wind particularly at great heights, can now be dispensed with. The expensive pretensioning of the cables is also avoided together with the devices required to maintain the tension. Since pretensioning is no longer necessary the upper carriage can be made of a lighter structure. This is particularly important with regard to the load-bearing capacity of the building, especially where there is damage at the top of the chimney stack or cooling tower.

Furthermore the expensive manufacture and fitting of the lower guide rail and the support consoles necessary therefor are all avoided.

The magnetic plate is advantageously designed as a permanent magnet. This design requires no feed supply.

In another advantageous embodiment, as electromagnet and current accumulator are installed in the magnetic plate. The current producer for the electromagnets is located in the work platform. The current accumulator or current producer can advantageously also feed the drives for the vertical and circular travel. Setting the current producer or current accumulator in the work platform has the special advantage that the movable cradle can be operated without a supply cable.

The magnetic strength is dependent on the relevant working conditions. It is determined by the building parameters, such as for example the height, shape or material of the building.

The work platform is fitted with castors which can be set transversely during horizontal travel and longitudinally during vertical travel. If the movable cradle is used on curved buildings, for example cooling towers, then any incline is compensated. Where the shape of the building is in the extreme the castors can advantageously be designed as ball rollers.

BRIEF DESCRIPTION OF THE DRAWINGS

An embodiment of the invention will now be described with reference to the drawings in which.

DESCRIPTION OF THE PREFERRED EMBODIMENT

Figure 1:
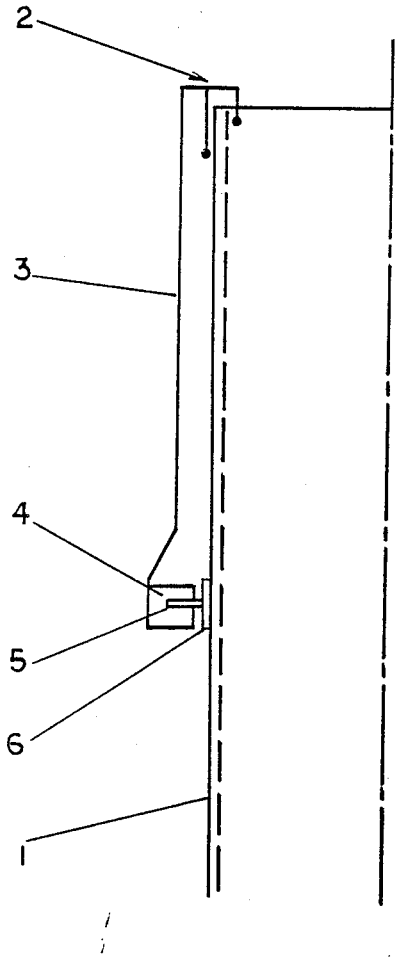
FIG. 1 is a diagrammatic view of a movable cradle mounted against a cylindrical building.
Figure 2:
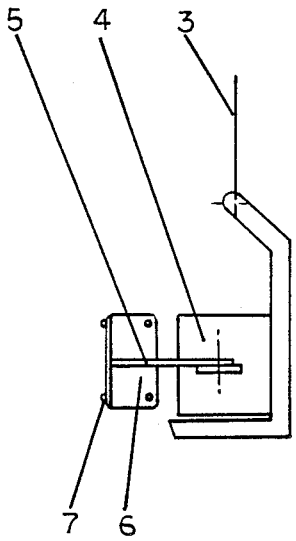
FIG. 2 is a diagrammatic side view of the movable cradle.
Figure 3:
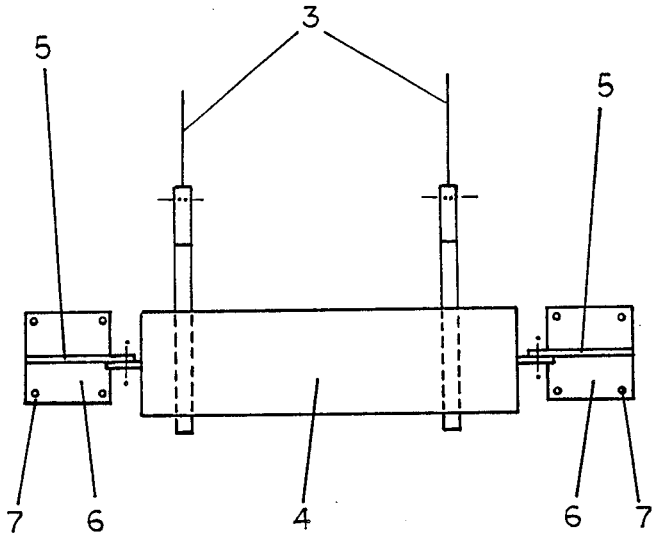
FIG. 3 is a diagrammatic front view of the movable cradle.

The platform 4 of a movable cradle illustrated in FIG. 1 is only suspended from the upper carriage 2 by means of the moving guide cables 3. The upper carriage is mounted at the top edge of a cylindrical building and can move in a circle along the edge of this cylindrical building in known way.

At each side the work platform 4 has a connected jib 5 which is fitted with a magnetic plate 6 at the end.

Figure 4:
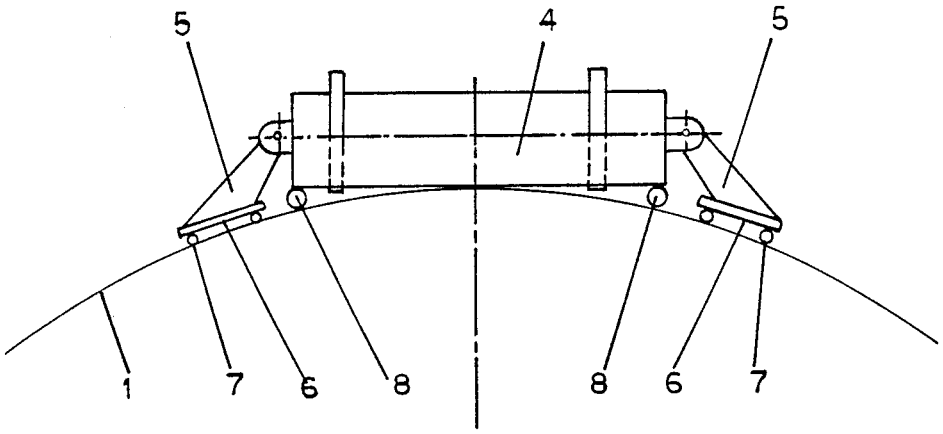
FIG. 4 is a diagrammatic plan view of a movable cradle pressed against a circular cylindrical surface.

As shown in FIGS. 1 and 4, the work platform 4 is held safely against the surface 1 of the building by means of the magnetic plates 6.

Each magnetic plate 6 is guided on the building surface 1 by ball rollers 7.

The work platform 4 has castors 8 which are set cross-wise for horizontal travel as shown diagrammatically in FIG. 4. For vertical travel these castors 8 are turned 90°.

All of these patents as well as other patents and patent applications identified in this specification are hereby fully incorporated by reference as if set forth in their entirety herein.

It may be appreciated that jib 5 may take the form of an arm or outrigger, since these devices are functional equivalents. Also it may further be appreciated that an electric power source may also be provided to power magnet plate 6 if magnet plate 6 is an electromagnet.

These patents are incorporated by reference as if set forth in their entirety herein.

The invention as described hereinabove in the context of a preferred embodiment is not be taken as limited to all of the provided details thereof, since modifications and variations thereof may be made without departing from the spirit and scope of the invention.

What is claimed is:

1. Movable cradle for the inside and outside walls of buildings made from reinforced concrete or steel wherein a work platform is suspended by movable guide cables from an upper carriage which can be moved along the top edge of the building, and can be moved vertically along these cables by a motor drive unit characterized in that a jib is attached to each side of the work platform and each jib is provided at its end with a magnetic plate which is fitted with ball rollers by means of which the work platform is moved over the surface of the building.

2. Movable cradle according to claim 1 characterized in that the magnetic plate is a permanent magnet.

3. Movable cradle according to claim 1 characterized in that the magnetic plate is an electromagnet.

4. Movable cradle according to claim 3 characterized in that a current accumulator or current producer for the electromagnet is mounted in the work platform.

5. Movable cradle according to claim 1 characterized in that the work platform is fitted with castors.

6. Movable cradle according to claim 5 characterized in that the castors are designed as ball rollers.

* * * * *